United States Patent [19]

Mori

[11] 4,114,301

[45] Sep. 19, 1978

[54] INDEXING DEVICE

[75] Inventor: Chuzo Mori, Tateishi, Japan

[73] Assignee: Carl Manufacturing Co., Ltd., Tokyo, Japan

[21] Appl. No.: 736,949

[22] Filed: Oct. 29, 1976

[30] Foreign Application Priority Data

Oct. 31, 1975 [JP] Japan ..... 131919

[51] Int. Cl.[2] ..... B42F 13/00

[52] U.S. Cl. ..... 40/389; 40/532; 40/509

[58] Field of Search ..... 40/104.01, 68.4, 78.05

[56] References Cited

U.S. PATENT DOCUMENTS

| | | | |
|---|---|---|---|
| 2,329,300 | 9/1943 | Rummler | 40/104.01 |
| 2,849,815 | 9/1958 | Neilsen | 40/104.01 |
| 2,960,781 | 11/1960 | Olson | 40/104.01 |
| 3,073,049 | 1/1963 | Levesque | 40/104.01 |

FOREIGN PATENT DOCUMENTS

| | | | |
|---|---|---|---|
| 1,154,437 | 9/1963 | Fed. Rep. of Germany | 40/104.01 |

*Primary Examiner*—John F. Pitrelli

*Attorney, Agent, or Firm*—Littlepage, Quaintance, Murphy, Richardson and Webner

[57] ABSTRACT

An indexing device consists of a base, a lid pivoted to the base, and a plurality of cards pivotally mounted between the lid and the base for selective movement with the lid. Each card has a lug at a front edge thereof, the plurality of cards being arranged such that the lugs are serially positioned at specific intervals in step-wise fashion. A like plurality of levers are pivoted to the base at corresponding specific intervals. A first end of each lever has a push-button fixed thereto for downward digital manipulation. The opposite end of each lever extends under the front edge of the cards for upward movement to select a desired number of cards to pivot upward with the opening of the lid.

10 Claims, 4 Drawing Figures

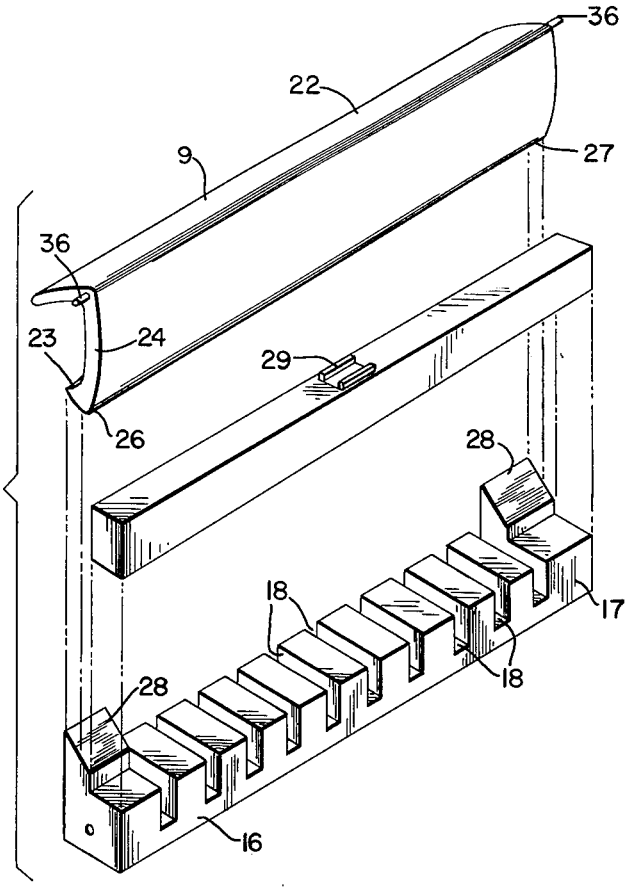
FIG. 4
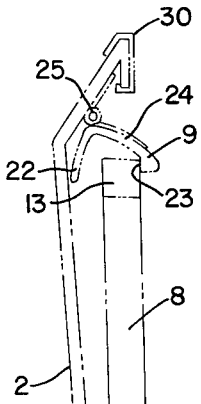
FIG. 2
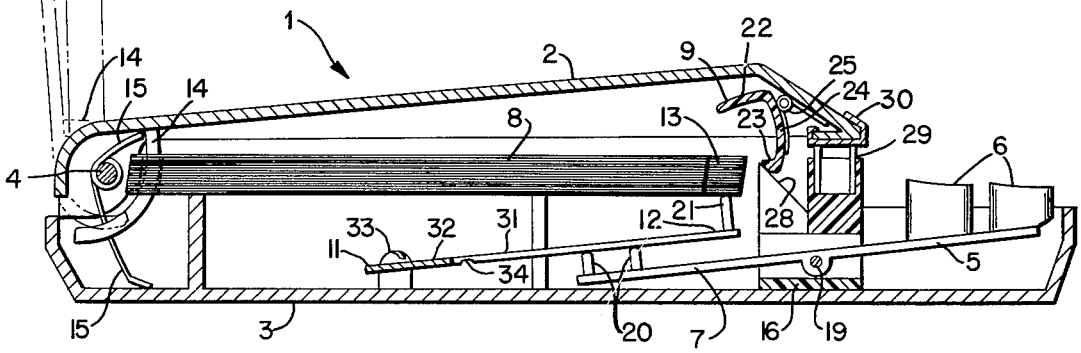

INDEXING DEVICE

BACKGROUND OF THE INVENTION

1. Field of the Invention

The present invention relates to an indexing device of the type generally comprising a base, a lid pivoted to the base, a plurality of flat, rectangular sheets or cards pivotally mounted between the lid and the base, and means for selecting one or more of the sheets or cards for quick and easy reference thereto. Indexing devices of this type have particular utility as personal telephone directories, address books and the like. The present invention relates more specifically to a device equipped with a plurality of push-button actuators which can open the lid and select the desired card or sheet in a single action.

2. Description of the Prior Art

In conventional indexing devices, the mechanism for selecting the card or cards to be used is usually a separate device from that mechanism which opens the lid of the indexing device together with the card or cards selected. Two steps of action are thus involved to select and open the index to the desired card or page, specifically, selection of the particular card or sheet and opening of the lid.

Indexing devices utilizing a single-touch type action, which are capable of executing these two steps simultaneously, are known in the prior art. Most of these devices are handicapped in that they involve quite complicated structure involving a large number of parts, and accordingly, such indexes have not met with any significant commercial success, since the cost of manufacturing and assembling the large number of parts represents a significant economic barrier to market penetration.

Accordingly, the primary object of the present invention is to provide a one-touch action type index device having a very simple structure, which is reliable in operation yet easy and inexpensive to assemble.

One feature of the present invention is a push-button mechanism capable of opening the lid and selecting a card in a single action, which produces a uniform force for pushing open the card index. Another feature of the present invention is a single element, elastic card selection mechanism which amplifies or enlarges the original stroke of the push-button mechanism. Yet another feature of the invention is a single, card-retaining mechanism mounted for movement with the lid, which retains the cards once selected.

SUMMARY OF THE INVENTION

The indexing device, according to the present invention, generally comprises a base, a lid pivoted to the base, and a plurality of cards pivotally mounted between the lid and the base for selected movement with the lid. Each card has a lug at a front edge thereof, the plurality of cards being arranged such that the lugs are serially positioned at specific intervals in step-wise fashion. A like plurality of levers are pivoted to the base at corresponding specific intervals. A first end of each lever has a push-button fixed thereto for downward digital manipulation, while the opposite end of each lever extends under the front edge of the cards for upward movement to select a desired number of cards to pivot upward with the opening of the lid.

An indexing device, according to this invention, can further comprise a plurality of intermediate arms positioned between each of the levers and each of the corresponding lugs on the cards for amplifying the motion of the levers as desired so as to provide a uniform opening force to the indexing lid and cards. Preferably the intermediate arms are all of equal length and are equally spaced from each other. One end of each intermediate arm is usually fixed to the base, while the other end of each intermediate arm is positioned under a selected one of the lugs on the front edge of the cards. The end of each lever opposite that end carrying the push-button contacts the underside of a corresponding intermediate arm approximately midway between the ends of the intermediate arm.

In a preferred embodiment, the plurality of intermediate arms comprises the teeth on one or more comb-like plates, the back of each comb-like plate being fixed to the base. The comb-like plate is preferably fabricated from the material having an elastic memory. Satisfactory materials for the comb-like plate are metals such as steel, bronze, and other materials including plastics having good, elastic spring characteristics, high modulus of elasticity and impact strength.

In a preferred embodiment, the plurality of intermediate arms comprise the teeth of a single comb-like plate which is fixed to the base. A concave groove is provided at the root of each tooth, the groove traversing the tooth so as to provide a point of flexibility for the tooth. The use of a single comb-like plate to form all of the intermediate arms is particularly advantageous in that only a single assembly step is necessary to place the intermediate arms in the desired position in the indexing device.

The indexing device, according to this invention, includes a retaining arm means pivoted to the lid for engaging the front edge of the preselected number of cards and retaining the cards for movement with the lid as it opens. In its preferred form, the retaining arm means comprises an elongate angle member pivoted at its ends to the lid. One leg of the angle member has an enlarged edge forming a hook for engaging the lugs on the front edge of the preselected number of cards. In one embodiment there is provided a biasing means for biasing the retaining arm toward the card-engaging position.

An indexing device, according to this invention, can also include a lever support means fixed to the base. The lever support means comprises a generally rectangular block, having a plurality of slots for receiving the plurality of levers. The plurality of slots maintains the levers at the desired specific intervals so as to properly position the push-buttons. The lever support includes a common access stem passing through the generally rectangular block perpendicular to the slots for pivotally supporting the levers. In a preferred embodiment the lever support means further comprises means for engaging the retaining arm means when the lid is in its closed, or nearly closed position so as to retract the retaining arm means from the card-engaging position.

The several features and advantages of an indexing device, according to the present invention, will become apparent to those of ordinary skill in the art by considering the following detailed description of preferred embodiments of the invention and by referring to the figures which form an integral part of this disclosure.

BRIEF DESCRIPTION OF THE DRAWINGS

FIG. 2 is a sectional view of the indexing device illustrated in FIG. 1 cut along line II—II, the lid of the indexing device being shown in the closed position and in phantom in open position.

FIG. 4 is an exploded perspective view showing the relation between the retaining arm means and the lever support means of a preferred embodiment of an indexing device according to this invention.

DESCRIPTION OF PREFERRED EMBODIMENTS

Figure 1:
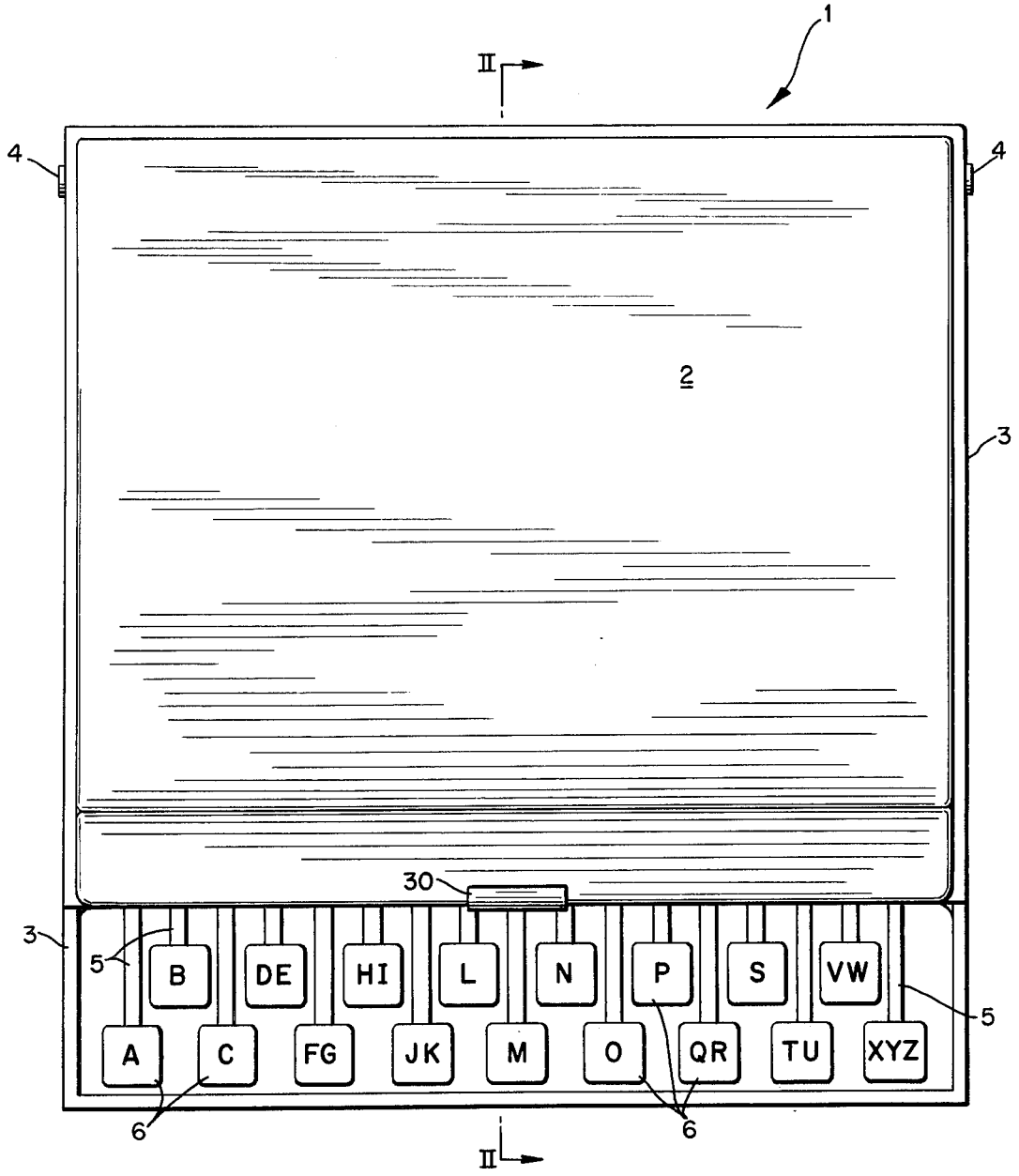
FIG. 1 is a plan view of an indexing device according to the present invention.

An indexing device 1 is illustrated in FIG. 1 having a lid 2 being closed upon a base 3. The lid 2 is pivoted to the base 3 by an axis or stem 4. The lid is openable by means of a plurality of levers 5, which are pivoted to the base 3 and are each provided by a push-button 6 fixed to a first end of each lever 5.

A downward push in the direction F on a push-button 6 as illustrated in FIG. 2 will result in the upward motion of the opposite end 7 of the lever selected, which will in turn, cause a number of the cards 8 to move upward toward the lid 2 and to be retained with the lid 2 by retaining arm means 9 as the lid opens to the position shown in phantom. The selection of the cards 8 is effected by a plurality of intermediate arms 10 positioned between the levers 5 and cards 8. One end 11 of the intermediate arms 10 is fixed to the base 3, while the other end 12 is positioned on the underside of the cards 8. The end 7 of each lever 5 contacts the underside of a corresponding intermediate arm 10 approximately midway between its ends 11 and 12.

Figure 3:
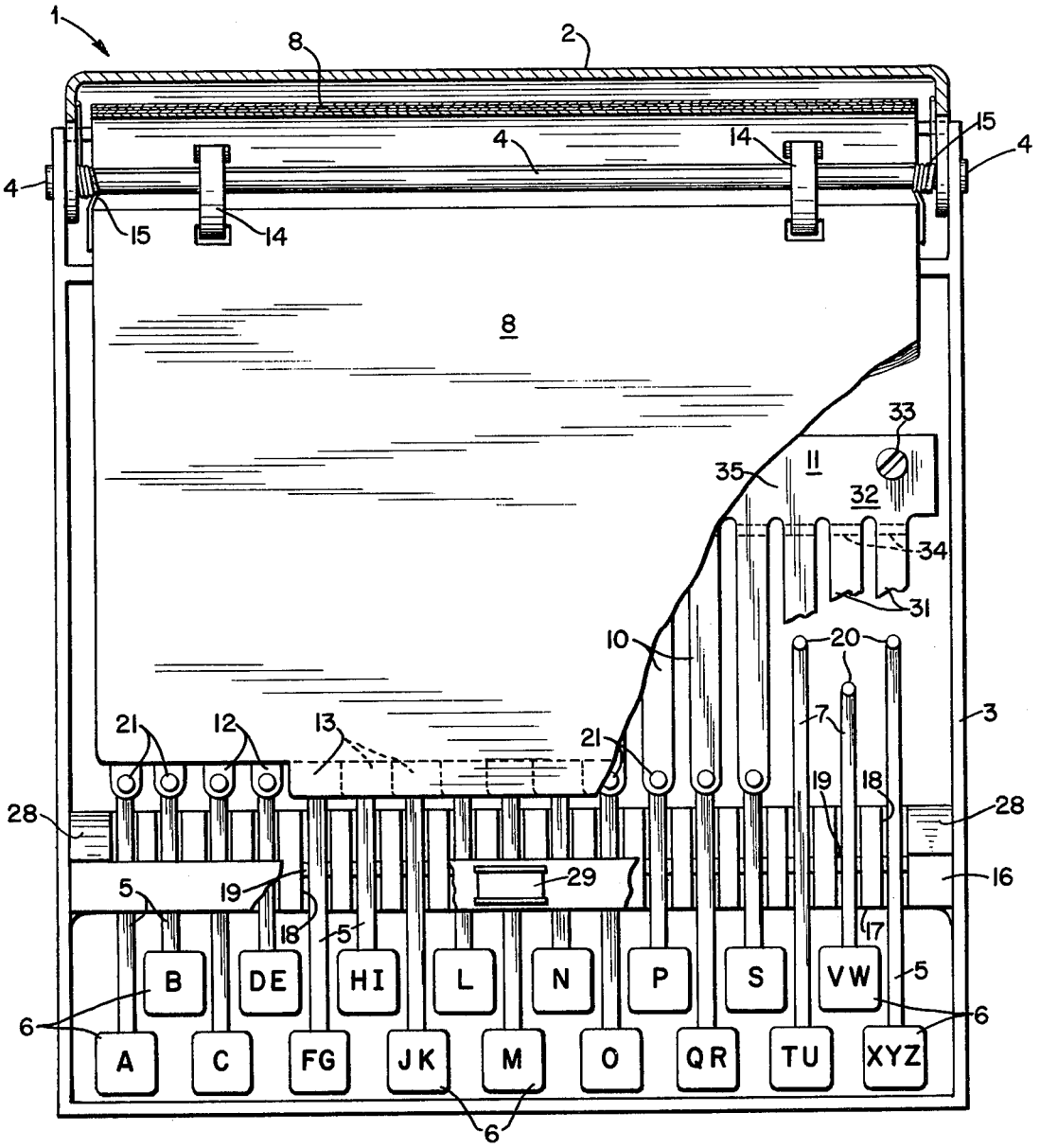
FIG. 3 is a partial, fragmentary view showing the indexing device illustrated in FIG. 1 with the lid in the open position so as to reveal a number of the plurality of cards in the index, the cards being cut away in part, to illustrate more clearly the working portion fixed to the base below the plurality of cards.

As illustrated in FIG. 3, each card 8 has a lug 13, the plurality of cards 8 being arranged such that the lugs 13 are serially positioned at specific intervals in step-wise fashion. The rear edges of the cards 8 are bound by arched-sections 14 projecting from the back of the lid 2. The lid 2 is biased toward the open position by means of springs 15 acting between the lid 2 and base 3.

The levers 5 are pivotally supported by a lever support means 16 fixed to the base 2. The lever support means comprises a generally rectangular block 17 having a plurality of slots 18 for receiving the plurality of levers 5 and maintaining the levers 5 at the desired spacing. A common axis or stem 19 passes through the block 17 perpendicular to the slots 18 and defines the pivot for the levers 5.

A downward digital manipulation of a push-button 6 causes the upward motion of tip 20 on the opposite end 7 of lever 5. Tip 20 contacts the lower surface of intermediate arm 10 and causes it, together with end 12, to move upward. Tip 21 on end 12 of intermediate arm 10 contacts the lower surface of a lug 13 of a card 8, causing that card 8 and all cards above it to move upward toward lid 2. The lugs 13 of the upward moving cards contact leg 22 of the card retaining arm 9, causing it to pivot in the clockwise direction as illustrated in FIG. 2.

As the retaining arm means 9 pivots in the clockwise direction, an enlarged edge 23 of the other leg 24 of the retaining arm 9 engages the lower surface of lug 13 of the bottom-most card 8, which was moved toward lid 2, holding the selected cards 8 for upward movement with the lid 2, as illustrated in phantom in FIG. 2. The retaining arm means 9 continues to hold the selected cards 8 with the lid 2 as it is biased toward the card-holding position by means of spring 25.

Upon closing lid 2, the two ends 26 and 27 of the enlarged edge 23 of the retaining arm 9 contact an inclined ramp 28, which forms a portion of the lever support means 16. The inclined ramp 28, acting on ends 26 and 27 of the retaining arm means 9, causes the retaining arm 9 to rotate in a counterclockwise direction against the biasing of spring 25 as the lid 2 is shut. A magnetic holding means 29 acts on a metal tab 30 with such strength as will overcome any biasing forces presented by springs 15 and 25 so as to retain lid 2 in the closed position until an additional initiating force F is again placed on a push-button 6.

Preferably, the plurality of intermediate arms 10 comprise the teeth 31 on a comb-like plate 32 fixed to the base 3 by appropriate fastening means 33. In order that the intermediate arms 10 move in the desired fashion, a concave groove 34 is provided at the root of each tooth, the groove traversing the tooth, thus permitting the back 35 of the comb-like plate 32 to remain stationary and fixed to base 3.

FIG. 4 illustrates the working relationship between the ends 26 and 27 of retaining arm means 9 and the ramp 28 of the support means 16. The retaining arm means 9 is pivoted to the lid 2 by means of pivots 36, best illustrated in FIG. 4. The push-buttons 6 are each provided with characters or codes, for example, the letters of the alphabet, solely to permit ready identification of the information on the corresponding cards in the indexing device. The push-buttons 6 are arranged in staggered fashion, and correspondingly, the opposite ends 7 of the levers 5 are also positioned in a staggered fashion as shown most clearly in FIG. 3. Since the projection 20 of each lever 5 is located approximately midway between the ends 11 and 12 of the intermediate arms 10, the stroke of the intermediate arm 10, or teeth 31 in particular, can be enlarged with respect to the stroke of the push-button 6. The staggered matching of the positions of the push-buttons 6 and the opposite ends 7 of each of the levers 5 permits a nearly uniform force against lugs 13 of the cards 8 by tips 21. This force is sufficient to not only raise the selected number of cards 8 toward the lid 2, but also to overcome the attractive force of the permanent magnet 29 for the metal element 30 on the lid, thus causing the lid to open under the action of the biasing springs 15. Thus it will be appreciated that the single action of pressing a push-button 6 causes both the action of selecting the desired card or cards 8 and opening the lid 2 of the index 1.

Although the invention has been described in considerable detail with reference to certain preferred embodiments thereof, it will be understood that variations and modifications can be effected within the spirit and scope of the invention as described above and as defined in the appended claims.

I claim:

1. An indexing device comprising:

(a) a base, (b) a lid pivoted to the base, (c) a plurality of cards pivotally mounted between the lid and the base for selective movement with the lid, each card having a lug at a front edge thereof, the plurality of cards being arranged such that the lugs are serially positioned at specific intervals in step-wise fashion, (d) a like plurality of levers pivoted to the base at corresponding specific intervals, a first end of each lever having a push-button fixed thereto for downward digital manipulation and the opposite end of each lever extending under the front edge of the cards for upward movement to select a desired number of cards to pivot upward with the lid, and (e) a plurality of intermediate arms, one intermediate arm positioned between each of the levers and each of the corresponding lugs on the cards for amplifying the motion of the levers, one end of each intermediate arm being fixed to the base, the other end of each intermediate arm being positioned under a selected one of said lugs, and said opposite end of each lever contacting the underside of a corresponding intermediate arm approximately midway between its ends.

2. The indexing device of claim 1 further comprising a retaining arm means pivoted to said lid for engaging the front edge of said desired number of cards and retaining the cards for movement with the lid.

3. The indexing device of claim 2 further comprising biasing means for biasing the retaining arm means toward the card-engaging position.

4. The indexing device of claim 2 wherein the retaining arm means comprises an elongate angle member pivoted at its ends to the lid, one leg of the angle member having an enlarged edge for engaging the lugs of said desired number of cards.

5. The indexing device of claim 4 further comprising a lever support-means fixed to the base, the lever support means comprising a generally rectangular block having a plurality of slots for receiving said plurality of levers and maintaining the levers at the desired specific intervals, and a common axis stem passing through the generally rectangular block perpendicular to the slots for pivotally supporting the levers.

6. The indexing device of claim 1 wherein the intermediate arms are all of equal length and are equally spaced from each other.

7. An indexing device comprising:

(a) a base, (b) a lid pivoted to the base, (c) a plurality of cards pivotally mounted between the lid and the base for selective movement with the lid, each card having a lug at a front edge thereof, the plurality of cards being arranged such that the lugs are serially positioned at specific intervals in step-wise fashion, (d) a like plurality of levers pivoted to the base at corresponding specific intervals, a first end of each lever having a push-button fixed thereto for downward digital manipulation and the opposite end of each lever extending under the front edge of the cards for upward movement to select a desired number of cards to pivot upward with the lid, and (e) a plurality of intermediate arms, one intermediate arm positioned between each of the levers and each of the corresponding lugs on the cards for amplifying the motion of the levers, the plurality of intermediate arms comprising teeth on at least one comb-like plate, the back of each comb-like plate being fixed to said base.

8. The indexing device of claim 7 wherein each comb-like plate is fabricated of an elastic material.

9. The indexing device of claim 7 wherein the plurality of intermediate arms comprise the teeth of a single comb-like plate.

10. The indexing device of claim 7 wherein a concave groove is provided at the root of each tooth, the groove traversing the tooth.

* * * * *